US008882005B2

(12) United States Patent
Eydner et al.

(10) Patent No.: US 8,882,005 B2
(45) Date of Patent: Nov. 11, 2014

(54) NOZZLE BAR FOR A TEXTILE PROCESSING MACHINE

(75) Inventors: Reinhold Eydner, Albstadt (DE); Thomas Schmid, Balingen (DE); Jürgen Spill, Nusplingen (DE); Achim Locher, Burladingen (DE)

(73) Assignee: Groz-Beckert KG, Albstadt (DE)

( * ) Notice: Subject to any disclaimer, the term of this patent is extended or adjusted under 35 U.S.C. 154(b) by 555 days.

(21) Appl. No.: 12/883,613

(22) Filed: Sep. 16, 2010

(65) Prior Publication Data

US 2011/0067458 A1 Mar. 24, 2011

(30) Foreign Application Priority Data

Sep. 18, 2009 (EP) ..... 09011917

(51) Int. Cl.

| | |
|---|---|
| ***A62C 2/08*** | (2006.01) |
| ***D04H 1/492*** | (2012.01) |
| ***B05B 1/14*** | (2006.01) |
| ***D04H 18/04*** | (2012.01) |
| *B05B 15/06* | (2006.01) |

(52) U.S. Cl.

CPC *D04H 1/492* (2013.01); *B05B 1/14* (2013.01); *D04H 18/04* (2013.01); *B05B 15/065* (2013.01)

USPC ..... 239/548; 239/566

(58) Field of Classification Search

CPC ..... B05B 7/08; B05B 7/0876; B05B 1/20

USPC ..... 239/547–549, 553.3, 553.5, 554, 556, 239/568, 566, 159

See application file for complete search history.

(56) References Cited

U.S. PATENT DOCUMENTS

| | | | |
|---|---|---|---|
| 1,020,024 | A | 3/1912 | Casebolt |
| 2,357,392 | A | 9/1944 | Francis |

(Continued)

FOREIGN PATENT DOCUMENTS

| | | | |
|---|---|---|---|
| CN | 1411519 | A | 4/2003 |
| CN | 101107392 | A | 1/2008 |

(Continued)

OTHER PUBLICATIONS

State Intellectual Property Office, P.R. China First Office Action and English Translation; Oct. 9, 2012; 13 pgs.

(Continued)

*Primary Examiner* — Davis Hwu

(74) *Attorney, Agent, or Firm* — Fitch, Even, Tabin & Flannery LLP

(57) ABSTRACT

A nozzle bar (10) comprising a carrier element (12) provided with several slit-shaped fluid channels (20), each associated with a foil (13) having a plurality of nozzle openings (15). In the position of use, the foil (13) is arranged over an input orifice (23) of the associate fluid channel (20) so that its nozzle openings (15) are located inside the contour of its associated fluid entry opening (19). In this position of use, each foil (13) is fastened to a plane attachment surface of the carrier element (12). The attachment surface may be the bottom (26) of a groove-like recess (25) in the carrier element (12). A separate recess (25) is provided for each foil (13). The carrier element (12) can be used for numerous different types of foils. The distance of the nozzle openings (15) of the foil (13), or the size or the form of the nozzle openings (15) may vary among various foil types, without requiring modifications on the carrier element (12).

15 Claims, 4 Drawing Sheets

(56) References Cited

U.S. PATENT DOCUMENTS

| | | | | |
|---|---|---|---|---|
| 2,609,539 | A | 9/1952 | Shearer | |
| 2,702,261 | A | 2/1955 | Bacon et al. | |
| 3,825,379 | A | 7/1974 | Lohkamp et al. | |
| 4,228,123 | A | 10/1980 | Marshall | |
| 4,522,716 | A * | 6/1985 | LaValley | 210/210 |
| 4,697,292 | A * | 10/1987 | LaValley | 8/156 |
| 4,714,647 | A | 12/1987 | Shipp et al. | |
| 4,795,558 | A * | 1/1989 | LaValley | 210/217 |
| 4,880,168 | A | 11/1989 | Randall, Jr. et al. | |
| 5,028,007 | A * | 7/1991 | Wokal | 239/518 |
| 5,235,733 | A | 8/1993 | Willbanks et al. | |
| 5,692,278 | A | 12/1997 | Fleissner | |
| 5,933,931 | A | 8/1999 | Greenway | |
| 6,230,776 | B1 | 5/2001 | Choi | |
| 6,668,436 | B2 | 12/2003 | Noelle et al. | |
| 7,237,308 | B2 | 7/2007 | Dixon et al. | |
| 7,303,465 | B2 | 12/2007 | Pourdeyhimi et al. | |
| 8,257,626 | B2 | 9/2012 | Kuehl | |
| 2002/0179744 | A1 | 12/2002 | Noelle et al. | |
| 2003/0116878 | A1 | 6/2003 | Takagaki | |
| 2004/0026543 | A1 | 2/2004 | Fleissner | |
| 2004/0078945 | A1 | 4/2004 | Fleissner | |
| 2004/0222322 | A1 * | 11/2004 | Erhard et al. | 239/549 |
| 2005/0219505 | A1 | 10/2005 | Iochi et al. | |
| 2006/0124772 | A1 | 6/2006 | Pourdeyhimi et al. | |
| 2008/0113054 | A1 | 5/2008 | Fegelman et al. | |
| 2011/0067213 | A1 | 3/2011 | Eydner | |
| 2011/0067214 | A1 | 3/2011 | Radle | |

FOREIGN PATENT DOCUMENTS

| | | |
|---|---|---|
| DE | 220060 | 3/1985 |
| DE | 3727843 | 1/1989 |
| DE | 19956368 | 6/2001 |
| DE | 10022297 | 11/2001 |
| DE | 10203719 | 7/2003 |
| DE | 102004030393 | 1/2006 |
| DE | 102005008647 | 8/2006 |
| EP | 1323857 | 7/2007 |
| JP | 49100374 | 9/1974 |
| WO | 9929950 | 12/1999 |
| WO | 0029656 | 5/2000 |
| WO | 0144553 | 6/2001 |
| WO | 0153587 | 7/2001 |
| WO | 0224998 | 3/2002 |
| WO | 0248441 | 6/2002 |
| WO | 03066948 | 8/2003 |
| WO | 2006063112 | 6/2006 |

OTHER PUBLICATIONS

European Patent Office, European Search Report, related application EP09011760, Jan. 15, 2010.

European Patent Office, European Search Report, related application EP09012009, Jan. 15, 2010.

European Patent Office, European Search Report, related application EP09011918, Jan. 27, 2010.

* cited by examiner

NOZZLE BAR FOR A TEXTILE PROCESSING MACHINE

CROSS-REFERENCE TO RELATED APPLICATION

The present application claims the priority of European Patent Application No. 09 011 917.3, filed Sep. 18, 2009, the subject matter of which, in its entirety, is incorporated herein by reference.

BACKGROUND OF THE INVENTION

The invention relates to a nozzle bar for a textile processing machine.

In order to compact fleece materials the use of textile processing machines has been known, wherein water is ejected at high pressure in very fine thin jets onto random fiber nonwovens. In so doing, the water jets take over the function of felting needles and of intertwining the fibers of the random fiber nonwoven in order to produce a compact fleece material.

To accomplish this, the textile machine comprises a nozzle bar containing a plurality of nozzle openings through which the water is formed into fine, needle-like water jets. The nozzle openings are subject to extremely high stress because the water may be subject to high pressure of several hundred Bar. Consequently, they are subject to considerable wear.

Document WO 2006/063112 A1 has disclosed a nozzle bar comprising a carrier element with cylindrical or conical bores. Separate therefrom, a strip-shaped cover element is provided, said element having a plurality of nozzle openings. When in a position of use, each nozzle opening is arranged so as to be in alignment with a bore of the carrier element. Pressurized water is supplied through the nozzle openings in the cover element and modulated to form a fine jet that subsequently exits—through the bores in the carrier element—from the nozzle bar.

Furthermore, U.S. Pat. No. 7,237,308 B2 describes a nozzle bar that also comprises a carrier element and, separate therefrom, a positioning bar. Also in this case, the carrier element has cylindrical bores that each are in alignment with a nozzle opening in the positioning bar. The positioning bar can be divided into several segments so that there is not a single positioning bar with all the nozzle orifices but several positioning bars are provided, each having a part of the nozzle orifices.

Considering this, the object of the present invention may be considered to be the improvement of the known nozzle bar.

SUMMARY OF THE INVENTION

The above object generally is achieved with a nozzle bar in accordance with the invention that comprises a carrier element that is provided with a fluid channel having an input orifice and an output orifice. When the nozzle bar is in the position of use, a foil having a plurality of nozzle openings is placed over the input orifice of the fluid channel. Each nozzle opening of a foil has a fluid entry opening as well as a fluid exit opening. Consequently, when the nozzle bar is in the position of use, all the fluid exit openings of the nozzle openings of the foil are associated with an input orifice of a shared fluid channel. During operation of the textile processing machine, pressurized fluid is formed into fine fluid jets by the nozzle openings. These jets exit at the output orifice of the fluid channel, without having the fluid jets coming into contact with the fluid channel or the carrier element. After the finely bundled fluid jets have exited, they impinge on the random fiber nonwoven in order to compact said nonwoven. The fluid that is being used may be gaseous or also liquid. Preferably, water is used as the fluid.

Inasmuch as each nozzle opening of a foil is associated with a shared fluid channel, placement of the foil on the carrier element is simplified. An exact alignment of each individual nozzle opening with a respectively separate bore in the carrier element is not necessary. In addition to simplified assembly, the nozzle bar in accordance with the invention also features the advantage that the use is clearly more flexible than that of the so-far known nozzle bars. Depending on the textile machine or on the random fiber nonwoven to be processed, different foils may be arranged on the carrier element. For example, the distance from the adjacent nozzle openings and/or their shape or diameter may be adapted to the specific situation of use. The same carrier element may be used for several foil types. All the nozzle openings of the foil are arranged in the region of the input orifice of the fluid channel so that the distance and size of the nozzle openings can be varied, without requiring any modification on the carrier element.

In the region of the input orifice of the fluid channel, the carrier element may have an attachment surface for the foil, said surface extending in one plane. This attachment surface may be aligned so as to be inclined relative to a reference plane. Preferably, the reference plane extends at a right angle with respect to the intended flow direction from a pressure source to the nozzle openings through the fluid channel. Corresponding to the inclination of the attachment surface, the foil attached thereto also extends so as to be inclined to the reference plane, so that the direction of ejection by the nozzle openings changes consistent with the inclination. In this manner, the ejection direction can be adapted to the nozzle openings, without modifying the foil of the nozzle openings.

Preferably, the input orifice as well as the output orifice of the fluid channel has the shape of a slit in the direction of extension of the nozzle bar. This simplifies the manufacture of the carrier element. Instead of several bores that—as in prior art—are respectively associated with one nozzle opening of the foil, several nozzle openings are associated with one fluid channel in accordance with the invention. In comparison with many bores, the fabrication of a few slit-like recesses in the carrier element is significantly more cost-effective. In a preferred embodiment, the nozzle openings in the foil are arranged at uniform distances in a row along a slit-shaped fluid channel and its input orifice.

Considering a preferred embodiment, the nozzle bar comprises exactly one carrier element to which several foils are fastened. In so doing, each foil may be associated with a separate fluid channel of the carrier element. Consequently each of the nozzle openings of a foil is associated with one of the fluid channels of the carrier element. Consequently, the carrier element extending in a longitudinal direction comprises several discrete fluid channels, thus increasing the stiffness of the carrier element compared with a carrier element having one continuous fluid channel extending in longitudinal direction. The stiffness can be further improved in that the slit-shaped fluid channels are provided in the carrier element so as to be inclined with respect to the longitudinal direction. Preferably, the fluid channels extend parallel to each other as do the foils arranged on the carrier element. In so doing, it is possible for foils that are arranged adjacent to each other on the carrier element to be offset next to each other—viewed in the direction in which they extend. Consequently, the foils are not arranged in alignment behind each other. As a result of this, it becomes possible that two foils arranged directly adjacent to each other on the carrier element are arranged so as to overlap with their respective end sections. Connecting means may be provided on this end section, so that the two foils can be detachably connected to each other.

Considering one of the advantageous embodiments of the nozzle bar, the input orifice of the fluid channel terminates in a recess of the carrier element. This recess is disposed for the placement of the foil. The installed foil may abut against the border of the recess at several points, as a result of which the relative position of the foil with respect to the carrier element is pre-specified. The nozzle openings of the foil that has been placed in the recess are then automatically positioned above the input orifice of the fluid channel. This enables a simplified assembly of the nozzle bar. This is expedient because a separate recess for each foil is provided in the carrier element. The recesses may be provided separate from each other. In order to be able to directly connect two adjacently arranged foils on the carrier element the recesses may communicate with each other at least in sections.

Advantageous embodiments of the invention are obvious from the dependent patent claims, the description and the drawings. Hereinafter, the invention will be explained in detail with reference to exemplary embodiments. The description is restricted to essential features of the invention and miscellaneous situations. The drawings are to be considered as being supplementary.

DETAILED DESCRIPTION OF THE INVENTION

Figure 1:
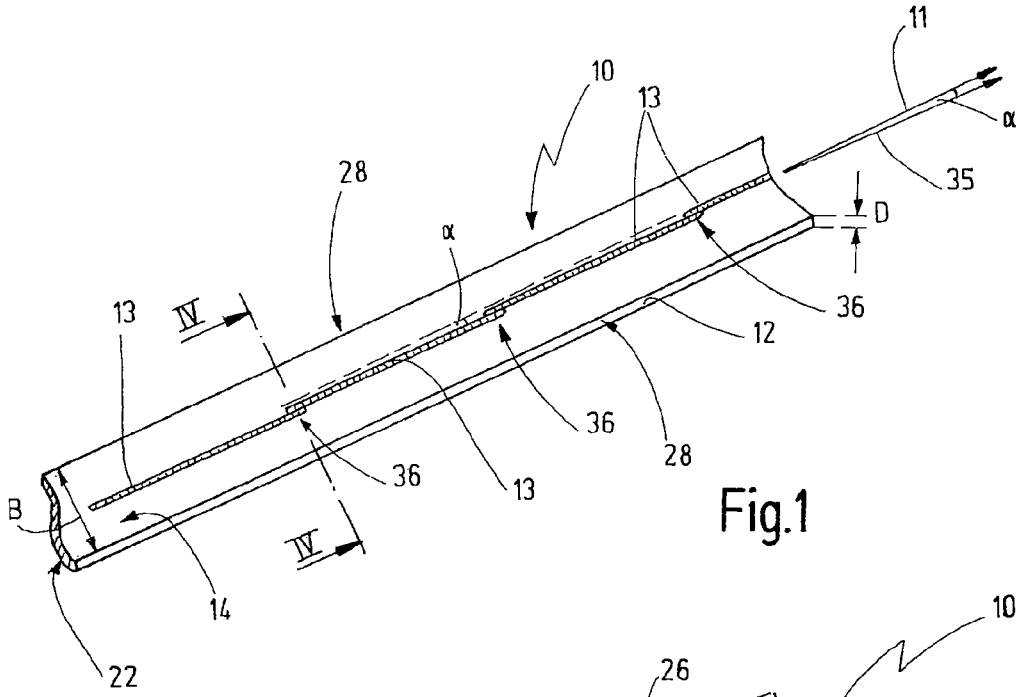
FIG. 1 is a perspective view of a detail of an exemplary embodiment of a nozzle bar.

The invention relates to a nozzle bar 10 comprising a carrier element 12 extending in a longitudinal direction 11, and several foils 13. The length of the carrier element 12 in longitudinal direction 11 may vary depending on the textile machine in which the nozzle bar 10 is installed and may have a length of up to several meters. Referring to the exemplary embodiment as in FIG. 1, the carrier element 12 may have a rectangular cross-section including a fluid exit side 22, a fluid entry side 14, and two narrow flat sides 28. The width B of the carrier element may be 10 mm to approximately 30 mm, and the thickness D may be approximately 1-4 mm.

Depending on the length of the carrier element 12 and thus of the nozzle bar 10, said nozzle bar is associated with several strip-shaped foils 13 that also display a rectangular cross-section. Referring to the exemplary embodiment, the foils 13 have a length of approximately 90-100 mm. They have thickness of 0.1-0.2 mm and a width of approximately 1-5 mm.

Figure 3:
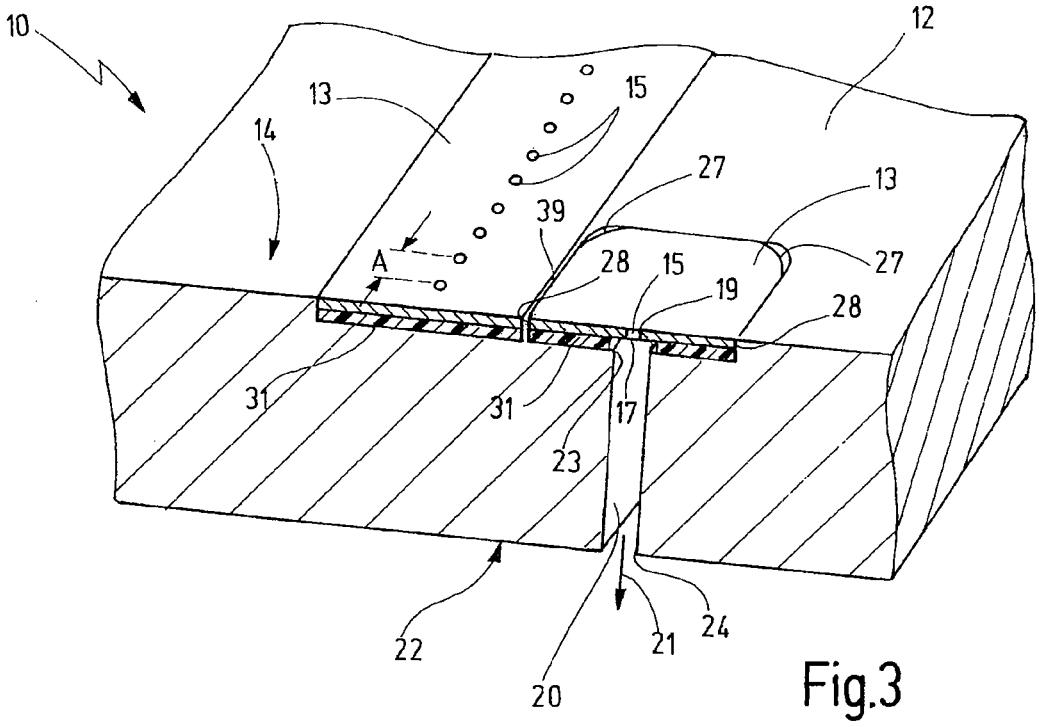
FIG. 3 is a perspective representation of the nozzle bar as in FIG. 1.
Figure 4:
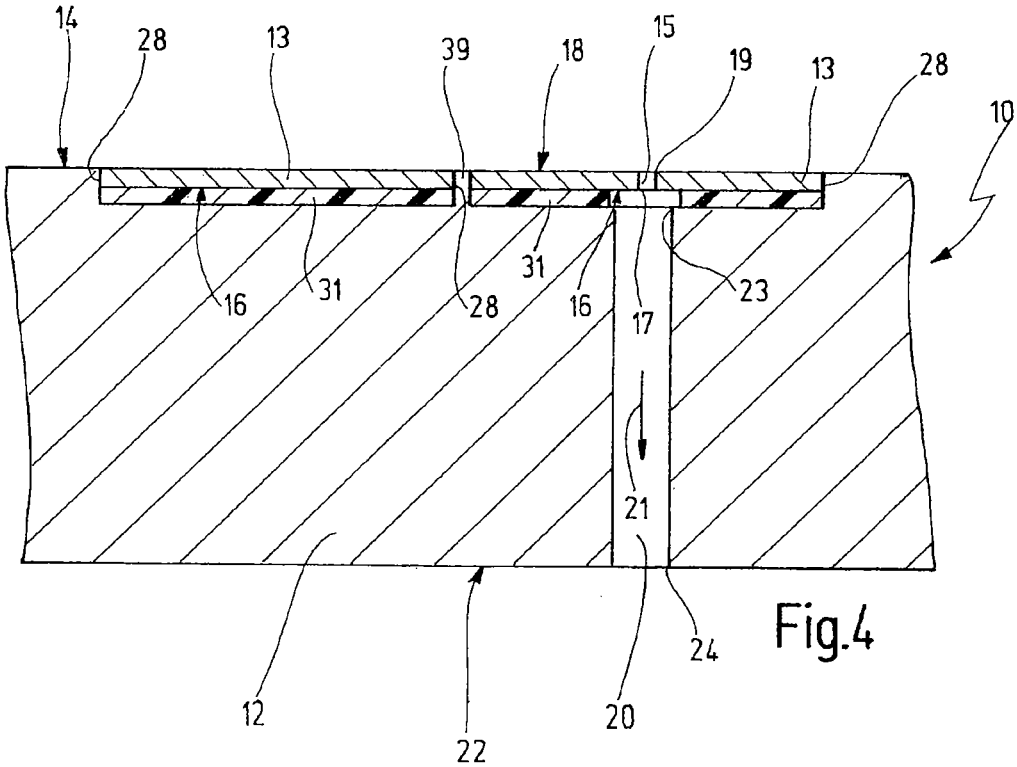
FIG. 4 is a cross-section, along sectional line IV-IV, of the nozzle bar as in FIG. 1.

Each foil 13 has a plurality of nozzle openings 15. The nozzle openings 15 completely extend through the foils 13 and have a fluid entry opening 19 and a fluid exit opening 17 (FIG. 4). Both the fluid entry opening 19 and the fluid exit opening 17 are circular. The diameter of the nozzle opening 15 preferably corresponds approximately to the thickness of the foil 13, and, in accordance with the example, is approximately 0.1 mm. In the exemplary embodiment, the nozzle openings 15—viewed in the direction of extension of the foil 13—are arranged at regular distances A from each other in a row along a straight line (FIG. 3). The distance A may be varied and may be, for example, approximately 1 mm. Preferably, the foils 13 are made of steel, hard metal or ceramic. When a metallic foil 13 is being used, said foil may be produced, for example, by means of a cutting or a non-cutting process.

Considering a modified, not illustrated, exemplary embodiment, the nozzle openings 15 may also be arranged in two or more rows next to each other along parallel straight lines. In so doing, it is possible to arrange the nozzle openings 15 in a matrix-like manner offset with respect to each other or it is possible to offset the nozzle arrays 15 of adjacent rows relative to each other.

In the position of use, the foils 13 are fastened to the carrier element 12. Referring to the preferred exemplary embodiment, the carrier element 12 contains several fluid channels 20 corresponding to the number of foils 13, said fluid channels completely extending through the carrier element 12 in a flow direction 21. On its fluid exit side 22 associated with the random fiber nonwoven to be processed—with the nozzle bar 10 in the position of use in the textile machine—the fluid channel 20 terminates forming an output orifice 24. The flow direction 21 corresponds to the flow direction of the fluid from a fluid entry opening 19 of the foil 13 associated with a pressure source of the textile machine via the fluid exit opening 17 of the foil 13 via an input orifice 23 of the fluid channel 20 to the output orifice 24. The fluid channel 20 has the form of a slit. Referring to the exemplary embodiment of the nozzle bar 10 shown by FIGS. 1 through 5, the slit-shaped fluid channel 20 extends inclined at an angle $\alpha$ with respect to the longitudinal direction 11 of the carrier element 12. The direction of extension of the slit-shaped fluid channel 20 pre-specifies the direction of extension 35 of the foil 13 arranged on the carrier element 12 in the position of use.

In accordance with the example, the cross-section of the fluid channel 20 is constant in flow direction 21 and corresponds to the form of the output orifice 24. Consequently, the fluid channel 20 has the shape of a slit. The fluid channel 20 may be provided in the carrier element 12 by various prior-art methods such as, for example, cutting or non cutting processes.

For fastening the foils 13, groove-shaped recesses 25 are provided in the carrier element 12 on the fluid entry side 14 of the carrier element 12. The number of recesses 25 corresponds to the number of foils 13 to be arranged on the carrier element 12. Each foil 13 is associated with a fluid channel 20. The recess 25 is formed by the bottom 26 and a contour. In so doing, the contour delimits the lateral extension of the recess 25 and thus defines the width and length of the recess 25, whereas the bottom 26 delimits the depth of the recess 25 and thus the height of the recess 25. The bottom 26 of each recess 25 represents an attachment surface for attaching the respective foil 13. The fluid channel 20 starts at its input orifice 23 in bottom 26 and ends on the fluid exit side 22. In the position of use, the inside 16 of the foil 13 is supported by the bottom 26 in a planar manner. The contours of the recess 25 substantially correspond to the contour of the foil 13, so that positioning of the nozzle openings 15 relative to the input orifice 23 of the fluid channel 20 is possible in a very easy manner. The position of the foil 13 is unmistakably pre-specified by the recess 25. As is obvious from FIGS. 2 and 3, the contour of the foil 13, in the preferred exemplary embodiment, is different—only on the rounded ends—from the contour of the associate recess 25, as a result of which gaps 27 are formed in the corner regions between the foil 13 and the recess 25, said gaps simplifying the placement of the foil 13 in recess 25 and the removal of said foil from said recess. The width and the length, respectively, of the recess 25 correspond to the width and the length, respectively, of the foil 13—taking into consideration the tolerances.

Referring to the foil 13 placed in the recess 25, the nozzle openings 15 are in alignment with the input orifice 23 of the fluid channel 20. In so doing, it is possible to place various types of foil in the recess 25 and to ensure—independent of distance A of the nozzle openings 15 or their size or contour—that a fluid jet formed by a nozzle opening 15 will not come into contact with the fluid channel or its walls or boundaries and thus will impinge in its unchanged form on the random fiber nonwoven that is to be compacted. Independent of the foil type that is being used, it is therefore possible to use the same carrier element 12, thus clearly increasing the flexibility of the nozzle bar 10. To accomplish this, it is necessary that the cross-section of the fluid channel 20 be dimensioned in such a manner that a fluid jet formed by a nozzle opening 15 will not contact the fluid channel 20 and thus may exit in its unchanged from the carrier material 12.

Referring to the first exemplary embodiment of the nozzle bar 10 in accordance with FIGS. 1 through 5, each foil 13 is made of a single material without joining or fastening points and is thus made of a single piece. Each foil 13 is associated with a completely bordered recess 25. The depth of the recess 25 is selected in such a manner that the outside 18 of the installed foil 13 extends in an essentially flat manner with respect to the area of the fluid entry side 14 of the carrier element 12 circumscribing the recesses 25.

As is illustrated by FIGS. 3 and 4, a sealing layer 31 may be provided between the foil 13 and the bottom 26 of the recess 25. The sealing layer 31 may consist of a sealing foil or of another sealing material and create a fluid-tight seal between the foil 13 and the carrier element 12. The sealing layer 31 may also be formed by an adhesive joint of adhesive, said adhesive being used to fasten the foil 13 to the attachment surface of the bottom 26.

Referring to the embodiment as illustrated by FIGS. 1 through 4, the bottom 26 extends in a plane that is aligned at a right angle to the flow direction 21 defined by the fluid channel 20. The cylindrical nozzle openings 15 are provided in the foil 13 at a right angle to the extension plane so that the ejection direction of the fluid jet exiting from the nozzle openings corresponds to the flow direction 21.

Figure 5:
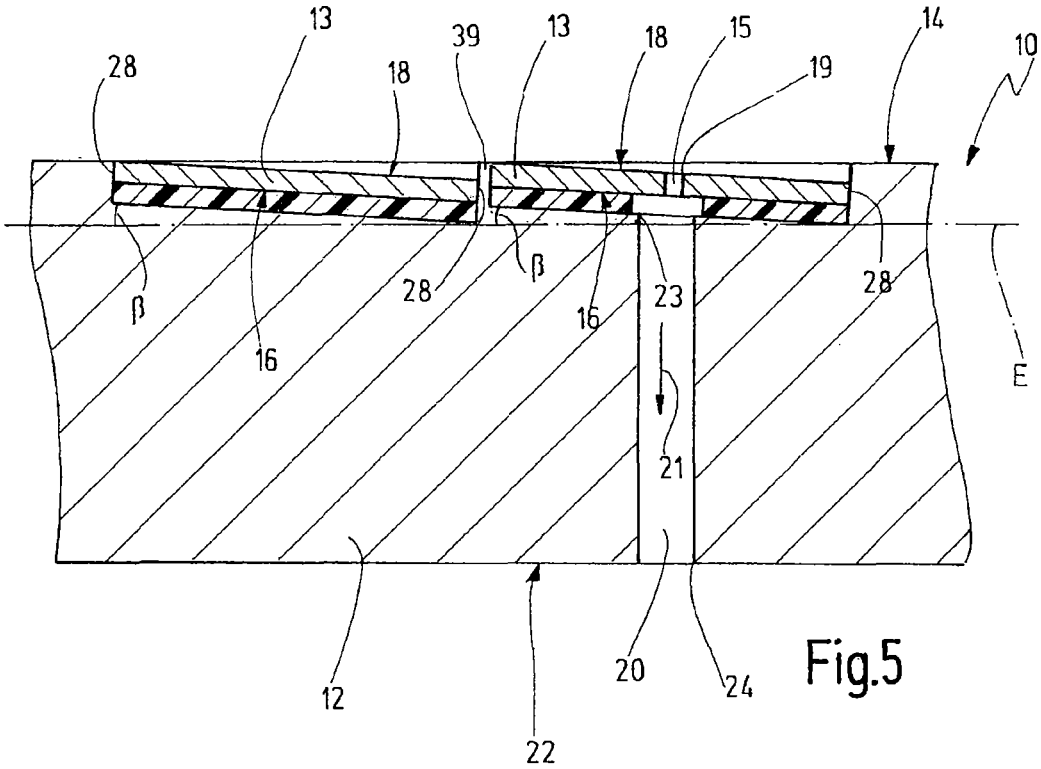
FIG. 5 is a cross-section of a modified exemplary embodiment of the nozzle bar.

FIG. 5 shows a modified embodiment, wherein the bottom 26 extends laterally inclined by an angle of inclination β with respect to the reference plane E in a direction transverse to the longitudinal direction 11. The reference plane E is aligned at a right angle with respect to the flow direction 21. There reference plane E may also be a horizontal plane with the bottom 26 being inclined relative to said plane—with the nozzle bar 10 in the position of use. In this manner the ejection direction of the fluid jet exiting from the nozzle openings can be adjusted in a very simple manner, without requiring a change on the foil 13 or the nozzle openings 15. The changed ejection direction of the fluid jet may require that the size of the fluid channel 20 be adapted accordingly, so that the fluid jet may flow in a contactless manner through the fluid channel 20 and act on the random fiber nonwoven. The same foil 13 as in the first exemplary embodiment in accordance with FIGS. 1 through 4 may be placed—with or without the sealing layer 31—in the recess 25 having the inclined attachment surface 26.

As has already been explained in conjunction with FIG. 1, the foils 13 extend at the angle α in a direction inclined with respect to the longitudinal direction 11 of the carrier element 12. Accordingly, the recesses 25 and the input orifices 23 of the fluid channel 20 of the carrier element 12—viewed in plan view on the carrier element 12—extend in an inclined manner relative to the longitudinal direction 11 subtending the angle α. This direction is referred to as the extension direction 35.

Figure 2:
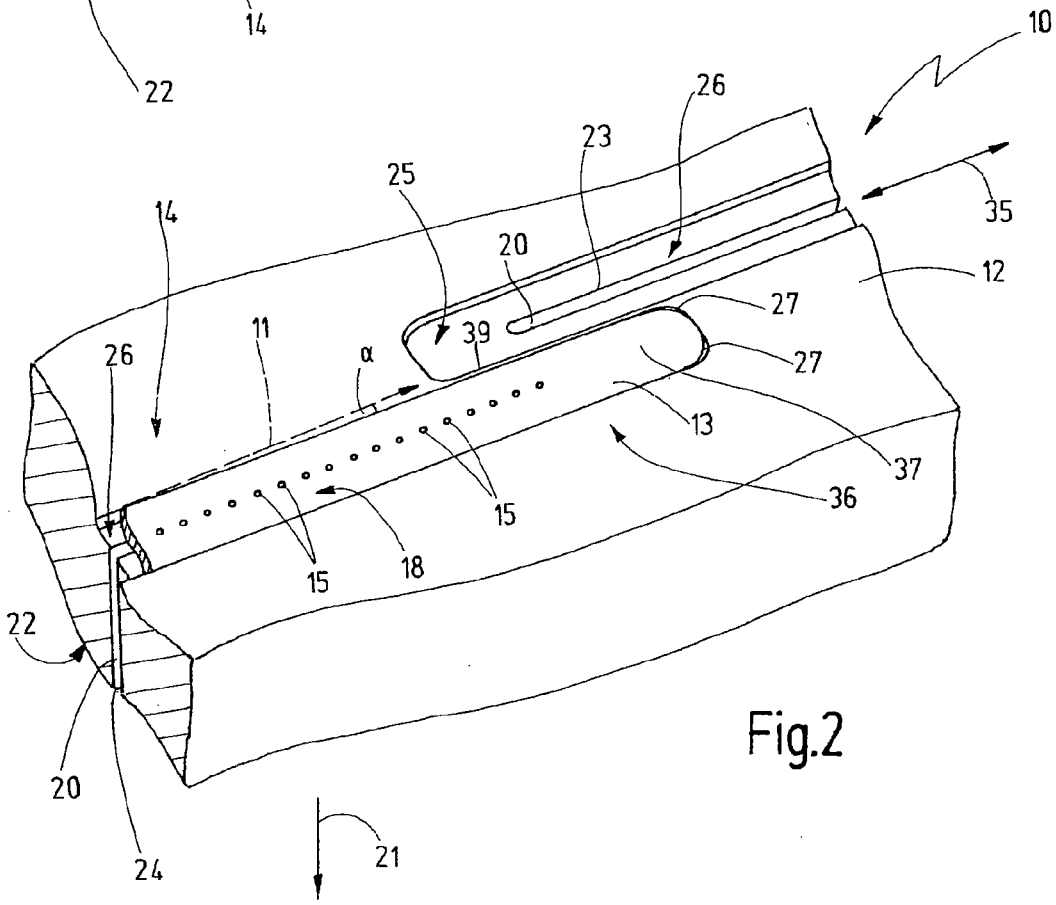
FIG. 2 is a perspective representation, partially in section, of a section of the nozzle bar as in FIG. 1.

Viewed in extension direction 35, two directly adjacent recesses 25 are arranged so as to be parallely offset with respect to each other. Viewed in extension direction 35, the recesses 25 are not in alignment. In an overlap region 36, two directly adjacent recesses 25 extend next to each other in extension direction 35 (FIG. 2). An end section 37 of a foil 13 is thus arranged—viewed in extension direction 35—next to the associate end section 37 of the adjacent foil 13. Referring to the exemplary embodiment of the nozzle bar 10 in accordance with FIGS. 1 through 5, completely bordered recesses 25 are provided, said recesses being separated from each other by a strip 39.

Referring to such a modified embodiment option of the nozzle bar 10, two directly adjacent recesses 25 are connected with each other in the overlap region 36. As a result of this measure, it is possible to connect the two adjacent foils 13 by connecting means 40 provided at the end regions 37 of the foils 13.

Figure 7:
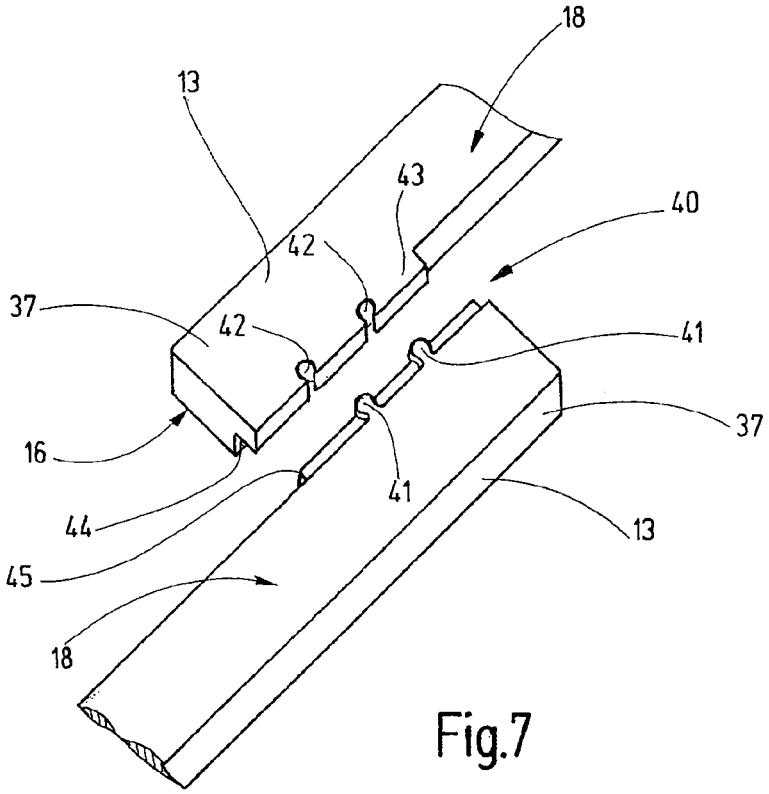
FIG. 7 is an exemplary embodiment of a foil with connecting means for connection with a directly adjacent additional foil.

Such an embodiment is schematically shown in FIG. 7, whereby, to avoid confusion, the nozzle openings 15 are not shown. Only the outer contour of the foil 13 is shown. As connecting means 40, each foil 13 has one or more connecting projections 41 on an end section 37, said projections projecting away from the end section 37 in a direction transverse to the extension direction 35. On its associate end section 37, the adjacent foil 13 has one or more connecting recesses 42 that come into engagement with the connection projections 41 when the connection of two foils 13 has been established. As a result of this, a form-fitting connection is being created. The connecting projections 41 widen toward their free end and are cambered in a manner similar to the connecting elements of the pieces of a puzzle.

The connecting recesses 42 are adapted to the contour of the connecting projections 41. Referring to the exemplary embodiment in accordance with FIG. 7 described here, the connecting recesses 42 are provided in a projection 43 that laterally projects from the foil 13, said projection extending flush with the outside 18 of the foil 13 and having a thickness that is smaller than the thickness of the remaining foil 13, as a result of which a clear space 44 is formed in the region under the connecting recesses 42. Under the connecting projections 41, a support element 45 is provided, said support element supporting the projection 43 when the connecting projections 4 come into engagement with the connecting recesses 42. In the exemplary embodiment, the contour of the support element 45 is adapted to the contour of the clear space 44.

It is understood that, as an alternative to the depicted embodiment options in accordance with FIG. 7, it is also possible to provide the connecting recesses 42 in the support element 45, in which case the connecting projections 41 are then appropriately arranged on the projection 43.

Figure 8:
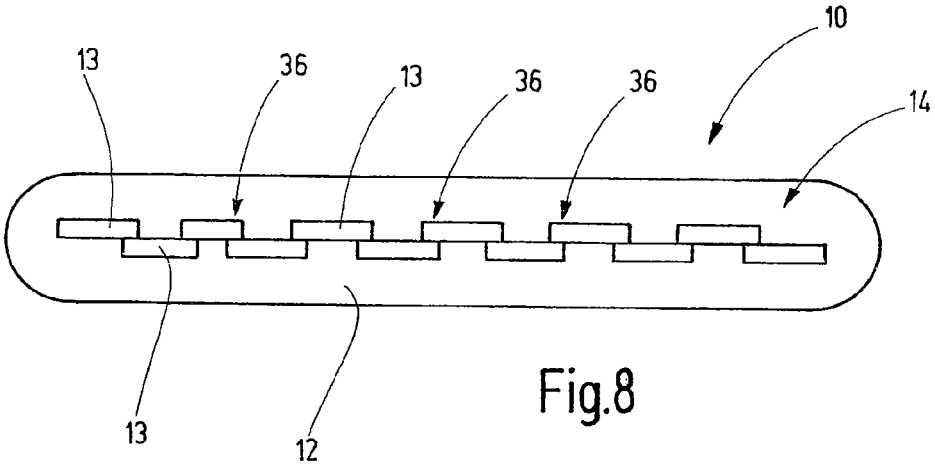
FIG. 8 is a modified exemplary embodiment of a nozzle bar.

Referring to a modification of an embodiment of the nozzle bar 10 as shown schematically in FIG. 8, the extension direction 35 of the foils 13 is aligned parallel to the longitudinal direction 11 of the carrier element 12. As it were, the foils 13 are arranged offset with respect to each other in two rows, whereby the foils 13 are spaced apart in the same row. The distance between two successive foils 13 of a row is smaller than the length of the foils 13 so that the overlap regions 36 are created. In the exemplary embodiment in accordance with FIG. 8, the foils 13 that are provided with the connecting means 40 can be used for the nozzle bar. Likewise, referring to the embodiment options of the nozzle bar 10 described in conjunction with FIGS. 1 through 5, the extension direction 34 and the longitudinal direction 11 may extend parallel to each other, and an arrangement of the foils 13 in accordance with FIG. 8 may be provided.

Figure 6:
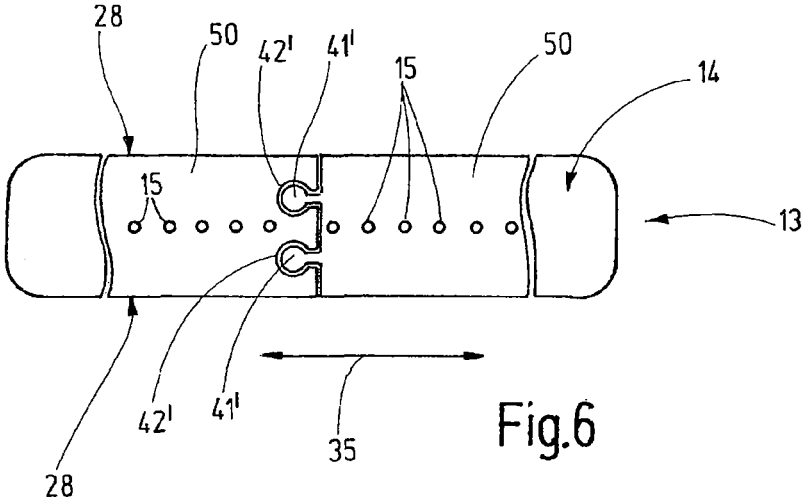
FIG. 6 is an exemplary embodiment of a foil divided into several segments that are connected with each other.

Referring to another modification, a foil 13 may consist of several segments 50 that can be joined to each other in extension direction 35. Referring to an exemplary embodiment of a segmented foil 13 as schematically shown in FIG. 6, two segments 50 are provided, whereby said segments can be connected to each other in a form-fitting manner. In conjunction with the connecting means explained in FIG. 7, it is also possible to join two segments 50. To do so, the connecting projections 41' are provided on a segment 50, said projections projecting from the respective segment 50 in extension direction 35, and, with the connection established between the two segments 50, come into engagement in a form-fitting manner with the connecting recesses 42' of the other segment 50.

During operation in the textile machine, fluid and, in particular, water, is conveyed by a pressure source through the nozzle openings 15 of the foil 13 in flow direction 21 to the output orifice 24 of the fluid channel 20 of the carrier element 12. Each of the fluid channels 20 is dimensioned such that the fluid is ejected in finely bundled water jets onto the random fiber nonwoven, without the fluid contacting the fluid channel 20. In this manner, the random fiber nonwoven is being compacted.

The present invention relates to a nozzle bar 10 comprising a carrier element 12 which is provided with several slit-shaped fluid channels 20. Each fluid channel 20 is associated with a foil 13 having a plurality of nozzle openings 15. In the position of use of the foil 13, said foil is arranged over an input orifice 23 of the associate fluid channel 20 so that its nozzle openings 15 are located inside the contour of its associate fluid entry opening 19. In this position of use, each foil 13 is fastened to a plane attachment surface of the carrier element 12. The attachment surface may be the bottom 26 of a groove-like recess 25 in the carrier element 12. A separate recess 25 is provided for each foil 13. The carrier element 12 can be used for numerous different types of foils. The distance of the nozzle openings 15 of the foil 13, or the size or the form of the nozzle openings 15 may vary among various foil types, without requiring modifications on the carrier element 12.

It will be appreciated that the above description of the present invention is susceptible to various modifications, changes and modifications, and the same are intended to be comprehended within the meaning and range of equivalents of the appended claims.

LIST OF REFERENCE NUMERALS

| | |
|---|---|
| 10 | Nozzle bar |
| 11 | Longitudinal direction |
| 12 | Carrier element |
| 13 | Foil |
| 14 | Fluid entry side of 12 |
| 15 | Nozzle openning |
| 16 | Inside of 13 |
| 17 | Fluid exit opening |

-continued

| | |
|---|---|
| 18 | Outside of 13 |
| 19 | Fluid entry opening |
| 20 | Fluid channel |
| 21 | Flow direction |
| 22 | Fluid exit side of 12 |
| 23 | Input orifice of 20 |
| 24 | Output orifice of 20 |
| 25 | Recess |
| 26 | Bottom of 25 |
| 27 | Gap |
| 28 | Flat side of 12 |
| 31 | Sealing layer |
| 35 | Direction of extension |
| 36 | Overlap region |
| 37 | Endsection of 13 |
| 39 | Strip |
| 40 | Connecting means |
| 41, 41' | Connecting projection |
| 42, 42' | Connecting recess |
| 43 | Projection |
| 44 | Clear space |
| 45 | Support element |
| 50 | Segment of 13 |
| E | Reference plane |

What is claimed is:

1. Nozzle bar (10) for a textile processing machine, said nozzle bar comprising:

a carrier element (12) having at least one fluid channel (20) with an input orifice (23), at least one foil (13), which, in a position of use, is connected with the carrier element (12), said foil having a plurality of nozzle openings (15) with one fluid entry opening (19) and one fluid exit opening (17), respectively, whereby the nozzle openings (15) are associated with the fluid channel (20) of the carrier element (12), and whereby, in the position of use, the fluid exit openings (17) of the nozzle openings (15) are located inside a contour of the input orifice (23) to direct fluid from the fluid exit openings (17) simultaneously into the input orifice (23).

2. Nozzle bar as in claim 1, characterized in that a bottom (26) for the foil (13) extending in one plane is provided in the region of the input orifice (23) of the fluid channel (20) on the carrier element (12).

3. Nozzle bar as in claim 1, characterized in that a bottom (26) is inclined with respect to a reference plane (D), whereby the reference plane (E) is aligned at a right angle to the intended flow direction (21) through the fluid channel (20).

4. Nozzle bar as in claim 1, characterized in that the output orifice (24) of the fluid channel (20) has the shape of a slit.

5. Nozzle bar for a textile processing machine, said nozzle bar comprising:

a carrier element (12) having at least one fluid channel (20) with an input orifice (23), at least one foil (13), which, in the position of use, is connected with the carrier element (12), said foil having a plurality of nozzle openings (15) with one fluid entry opening (19) and one fluid exit opening (17), respectively, whereby the nozzle openings (15) are associated with the fluid channel (20) of the carrier element (12), and whereby, in the position of use, the fluid exit opening (17) of the nozzle opening (15) is located inside a contour of the input orifice (23);

characterized in that the nozzle bar (10) comprises exactly one carrier element (12), said carrier element having several fluid channels (2) and having several foils (13) arranged thereon.

6. Nozzle bar as in claim 1, characterized in that the nozzle bar (10) comprises exactly one carrier element (12), said carrier element having several fluid channels (2) and having several foils (13) arranged thereon.

7. Nozzle bar as in claim 6, characterized in that each foil (13) is associated with a separate fluid channel (20) of the carrier element (12).

8. Nozzle bar as in claim 6, characterized in that the foils (13) are aligned parallel to each other.

9. Nozzle bar as in claim 6, characterized in that foils (13) arranged adjacent to each other on the carrier element (12) are arranged—viewed in their extension direction (35)—so as to be offset next to each other.

10. Nozzle bar as in claim 6, characterized in that a foil (13) has an end section (37), on which are provided at least parts of the connecting means (40) for connecting the foil (13) with another foil (13).

11. Nozzle bar as in claim 1, characterized in that the input orifice (23) of the fluid channel (20) terminates in a recess (25) of the carrier element (12), said recess being provided for the placement of the foil (13).

12. Nozzle bar as in claim 11 or claim 6, characterized in that one recess (25) in the carrier element (12) is provided for each foil (13).

13. Nozzle bar as in claim 12, characterized in that adjacent recesses (25) provided on the carrier element (12) communicate with each other.

14. Nozzle bar as in claim 1, characterized in that the nozzle openings (15) have a cylindrical form.

15. Nozzle bar as in claim 1, characterized in that the nozzle openings (15) are arranged at regular distances from each other in a row on the foil (13).

* * * * *